US007233116B2

(12) United States Patent
Yeh et al.

(10) Patent No.: US 7,233,116 B2
(45) Date of Patent: Jun. 19, 2007

(54) METHOD FOR STABILIZING BRIGHTNESS OF A COLD CATHODE FLUORESCENT LAMP AND RELATED APPARATUS

(75) Inventors: Chia-Tse Yeh, Tao-Yuan Hsien (TW); Yu-Ching Chuang, Chung-Li (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 11/278,967

(22) Filed: Apr. 7, 2006

(65) Prior Publication Data

US 2006/0226792 A1 Oct. 12, 2006

(30) Foreign Application Priority Data

Apr. 7, 2005 (TW) ..... 94111041 A

(51) Int. Cl.
*G05F 1/00* (2006.01)

(52) U.S. Cl. ..... 315/291; 315/307; 315/274; 315/224; 315/312

(58) Field of Classification Search ..... 315/291, 315/307, 224, 274, 282, 312
See application file for complete search history.

(56) References Cited

U.S. PATENT DOCUMENTS 7,126,289 B2 * 10/2006 Lin et al. ..... 315/308

* cited by examiner

*Primary Examiner*—Tuyet Thi Vo
(74) *Attorney, Agent, or Firm*—Winston Hsu

(57) ABSTRACT

A method for stabilizing brightness of a cold cathode fluorescent lamp includes receiving currents from two ends of the cold cathode fluorescent lamp and providing a current for the cold cathode fluorescent lamp according to a lower current of the currents received from the two ends of the cold cathode fluorescent lamp.

5 Claims, 8 Drawing Sheets

METHOD FOR STABILIZING BRIGHTNESS OF A COLD CATHODE FLUORESCENT LAMP AND RELATED APPARATUS

BACKGROUND OF THE INVENTION

1. Field of the Invention

The present invention provides a method for stabilizing brightness of a cold cathode fluorescent lamp, and more particularly, a method for stabilizing brightness of the cold cathode fluorescent lamp according to feedback of a lower current of two ends of the cold cathode fluorescent lamp.

2. Description of the Prior Art

Regarding to a cathode ray tube (CRT) monitor, a flat panel display (FPD) monitor has incomparable advantages, such as low power consumption, no radiation, small volume, etc., so that the FPD monitor has become a substitute for the CRT monitor. As FPD technology advances, prices of FPD monitors are reduced, which makes FPD monitors more popular. However, a FPD monitor with large window size must include a high-efficiency cold cathode fluorescent lamp, or CCFL. A drive circuit of the CCFL includes factors greatly affecting stability of the CCFL when transforming electricity into light. The factors, such as an input current degree, outside temperature, triggering waveforms, lamp size, inner gases of the CCFL, and even distance between adjacent devices, generate a complex non-linear response in the CCFL, and change the brightness of the CCFL. Moreover, in order to reduce electromagnetic interference, the CCFL is covered by a conductive layer, which is coupled to a system ground. Therefore, between the CCFL and the system ground there is a significant parasitic capacitance.

Please refer to FIG. 1 and FIG. 2. FIG. 1 illustrates a schematic diagram of a prior art light source device 10 of a FPD monitor, while FIG. 2 illustrates a schematic diagram of a thermometer effect. In FIG. 1, a power controller 100 provides alternating currents for a CCFL 104 through a transformer 102. The CCFL 104 generates light corresponding to different current levels, and feeds a current of one end of the CCFL 104 back to the power controller 100. As shown in FIG. 1, one end of the CCFL 104 is coupled to a high alternating current and the other end of the CCFL 104 is coupled to a system ground through a resistor 108, which forms an electromagnetic field (EMF) gradient. The EMF gradient in the CCFL 104 makes the CCFL 104 brighter in one end and darker in the other end, which is due to the thermometer effect shown in FIG. 2. The thermometer effect is stronger when the CCFL 104 receives a lower degree current. Moreover, as mentioned above, the CCFL 104 is covered by a conductive layer, causing significant parasitic capacitance between the CCFL 104 and the system ground, which is represented by a capacitor 106 in FIG. 1. The capacitor 106 results in current leakage from the CCFL 104 to the system ground, so that the power controller 10 cannot detect the exact current in the CCFL 104.

In order to improve the thermometer effect, the prior art will float the CCFL. Please refer to FIG. 3 and FIG. 4, which illustrate schematic diagrams of a light source device 30 and 40 of FPD monitors. The light source device 30 and 40 can improve the thermometer effect. The light source device 30 provides currents for a CCFL 302 according to a feedback current from a primary end of a transformer 300, while the light source device 40 provides currents for a CCFL 402 according to a feedback current from a secondary end of a transformer 400. The light source device 30 and 40 can reduce the thermometer effect caused by the parasitic capacitance. However, since terminals of the CCFL 302 and the CCFL 402 are coupled to high voltage sources, different feedback points between the light source device 30 and the light source device 40 make currents to be provided for the CCFL 302 and 402 change in response to different stray capacitances. As a result, brightness of the CCFL 302 and 402 cannot be stable.

In short, the prior art light source devices are affected by problems of the thermometer effect, parasitic capacitance, and current leakage, which reduce stability of the CCFL and system efficiency.

SUMMARY OF THE INVENTION

It is therefore a primary objective of the claimed invention to provide a method for stabilizing brightness of a cold cathode fluorescent lamp and related apparatus.

The present invention discloses a method for stabilizing brightness of a cold cathode fluorescent lamp, which includes: receiving currents from two ends of the cold cathode fluorescent lamp; and providing a current for the cold cathode fluorescent lamp according to a lower current of the currents received from the two ends of the cold cathode fluorescent lamp.

The present invention further discloses a light source device capable of stabilizing brightness, which includes a cold cathode fluorescent lamp; a current comparison unit coupled to two ends of the cold cathode fluorescent lamp for comparing currents of the two ends of the cold cathode fluorescent lamp and outputting corresponding signals; and a power controller coupled to the current comparison unit for providing a current for the cold cathode fluorescent lamp according to signals outputted from the current comparison unit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
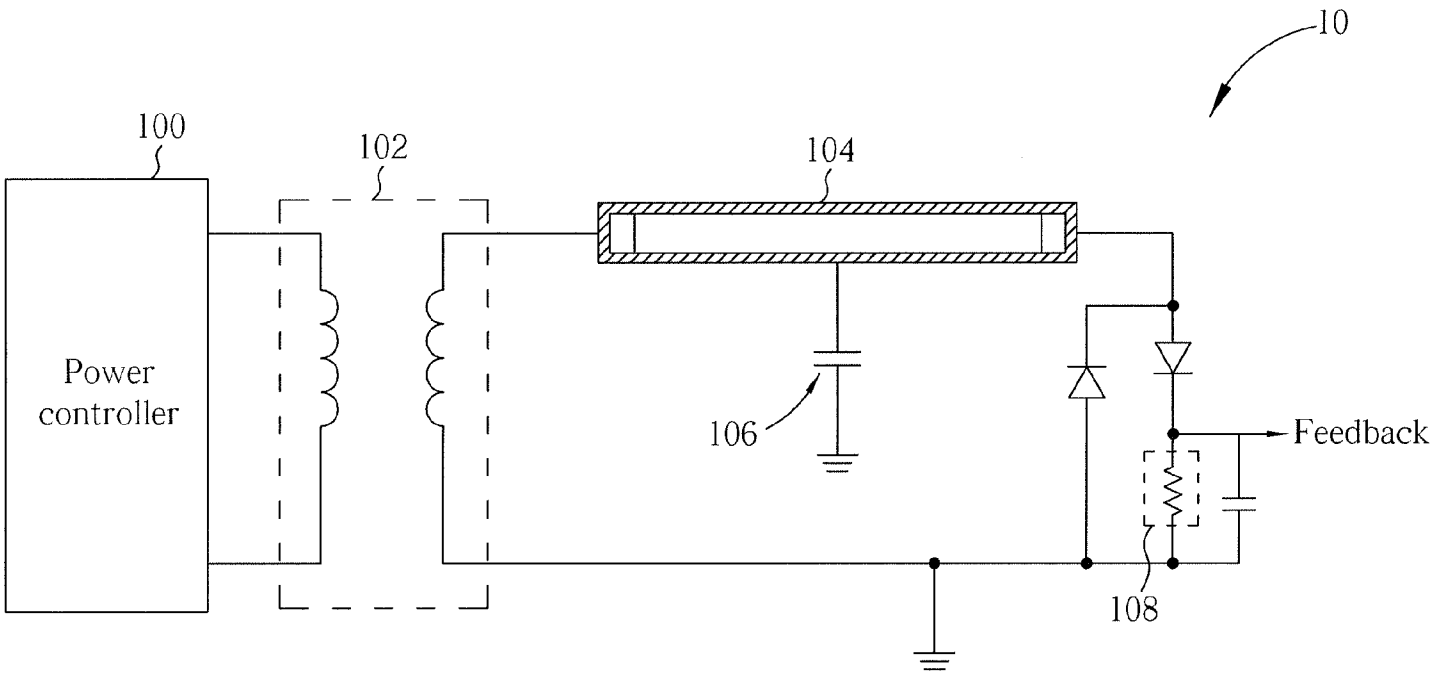
Fig. 1 Prior Art
FIG. 1 illustrates a schematic diagram of a prior art light source device of a FPD monitor
Figure 2:
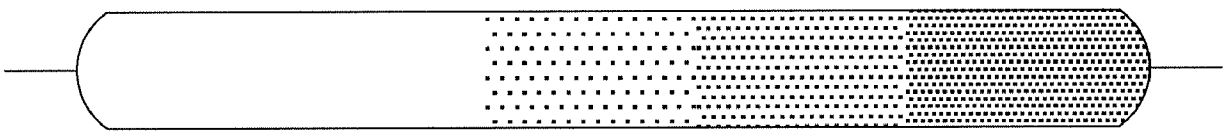
Fig. 2 Prior Art
FIG. 2 illustrates a schematic diagram of a thermometer effect.
Figure 3:
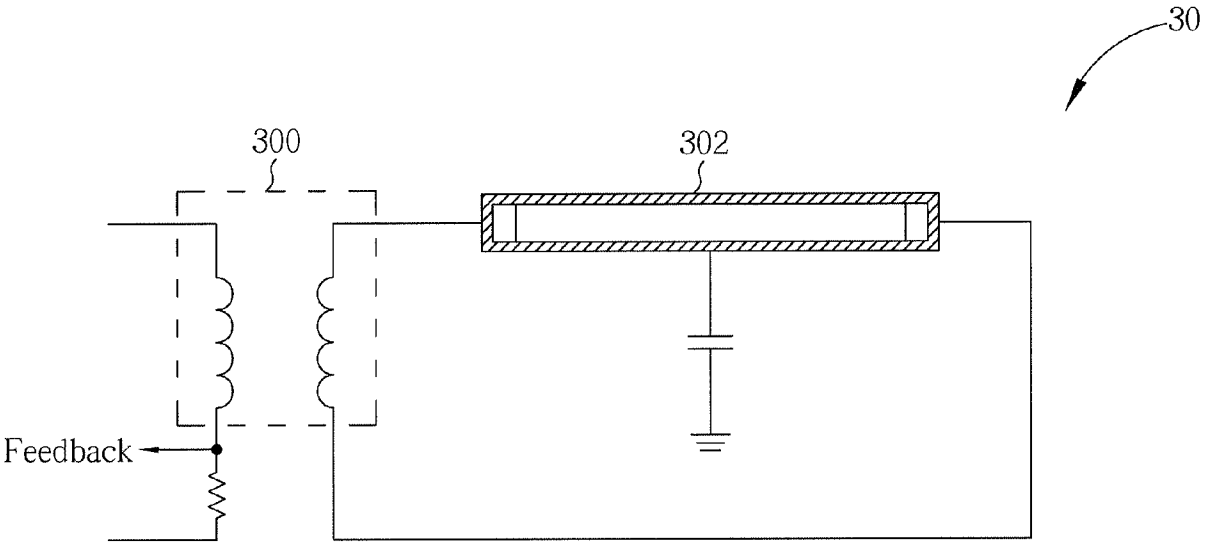
Fig. 3 Prior Art
FIG. 3 illustrate a schematic diagram of a prior art light source device of a FPD monitor.
Figure 4:
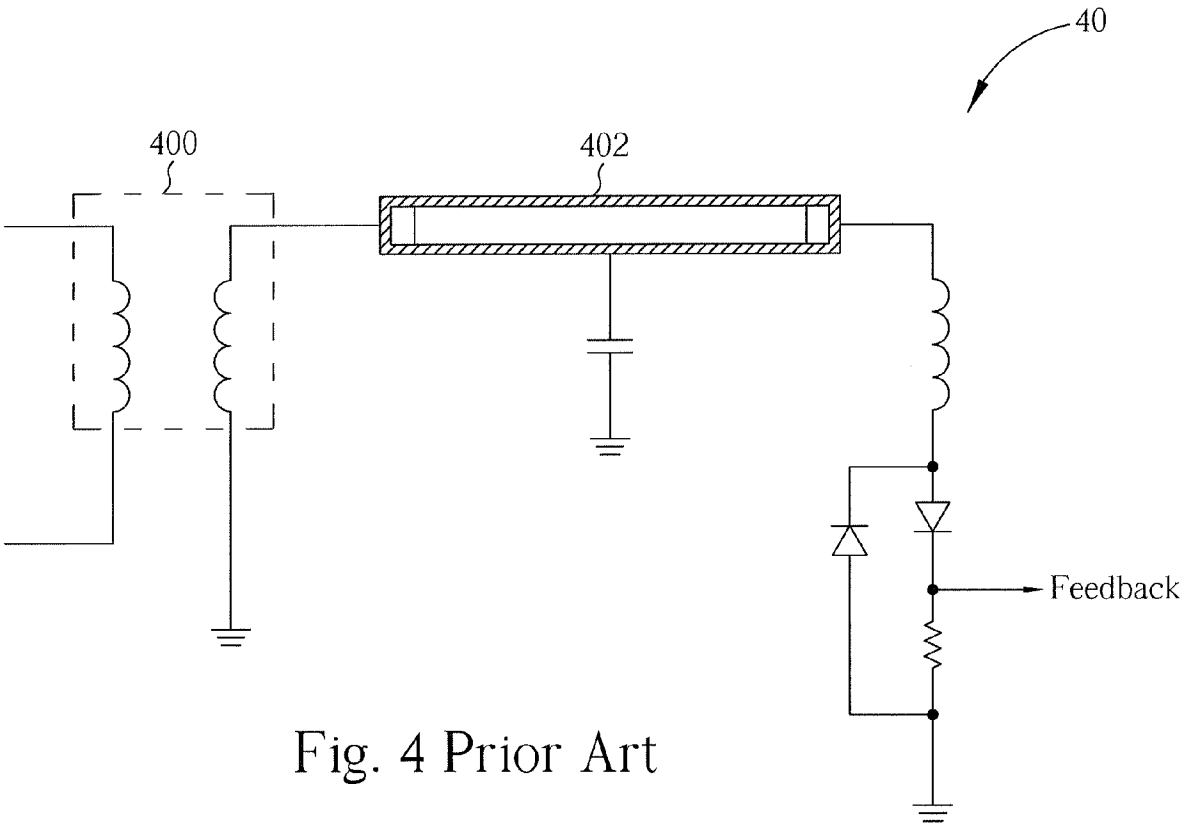
Fig. 4 Prior Art
FIG. 4 illustrate a schematic diagram of a prior art light source device of a FPD monitor.
Figure 5:
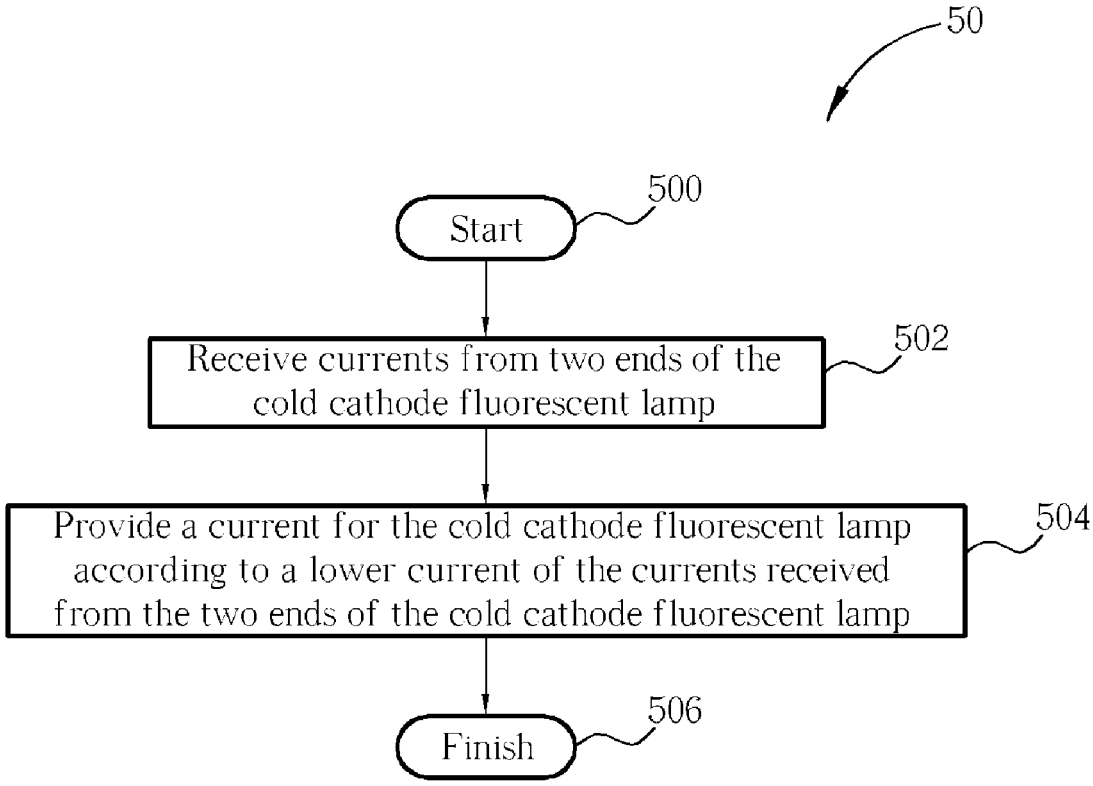
FIG. 5 illustrates a flowchart of a process for stabilizing brightness of a CCFL in accordance with the present invention.

Please refer to FIG. 5, which illustrates a flowchart of a process 50 for stabilizing brightness of a CCFL in accordance with the present invention. The process 50 includes the following steps:

Step 500: start.

Step 502: receive currents from two ends of the cold cathode fluorescent lamp.

Step 504: provide a current for the cold cathode fluorescent lamp according to a lower current of the currents received from the two ends of the cold cathode fluorescent lamp.

Step 506: finish.

Therefore, according to the process 50, the present invention takes a lower current within two ends of a CCFL as a feedback signal, and adjusts currents inputted to the CCFL accordingly, so as to increase stability of currents in the CCFL. That is, the present invention receives the currents (or voltages) from the two ends of the CCFL, and selects the lower-current end as a feedback source. Therefore, the present invention prevents the thermometer effect, reduces current leakage caused by parasitic capacitance, and increases accuracy and efficiency.

Figure 6:
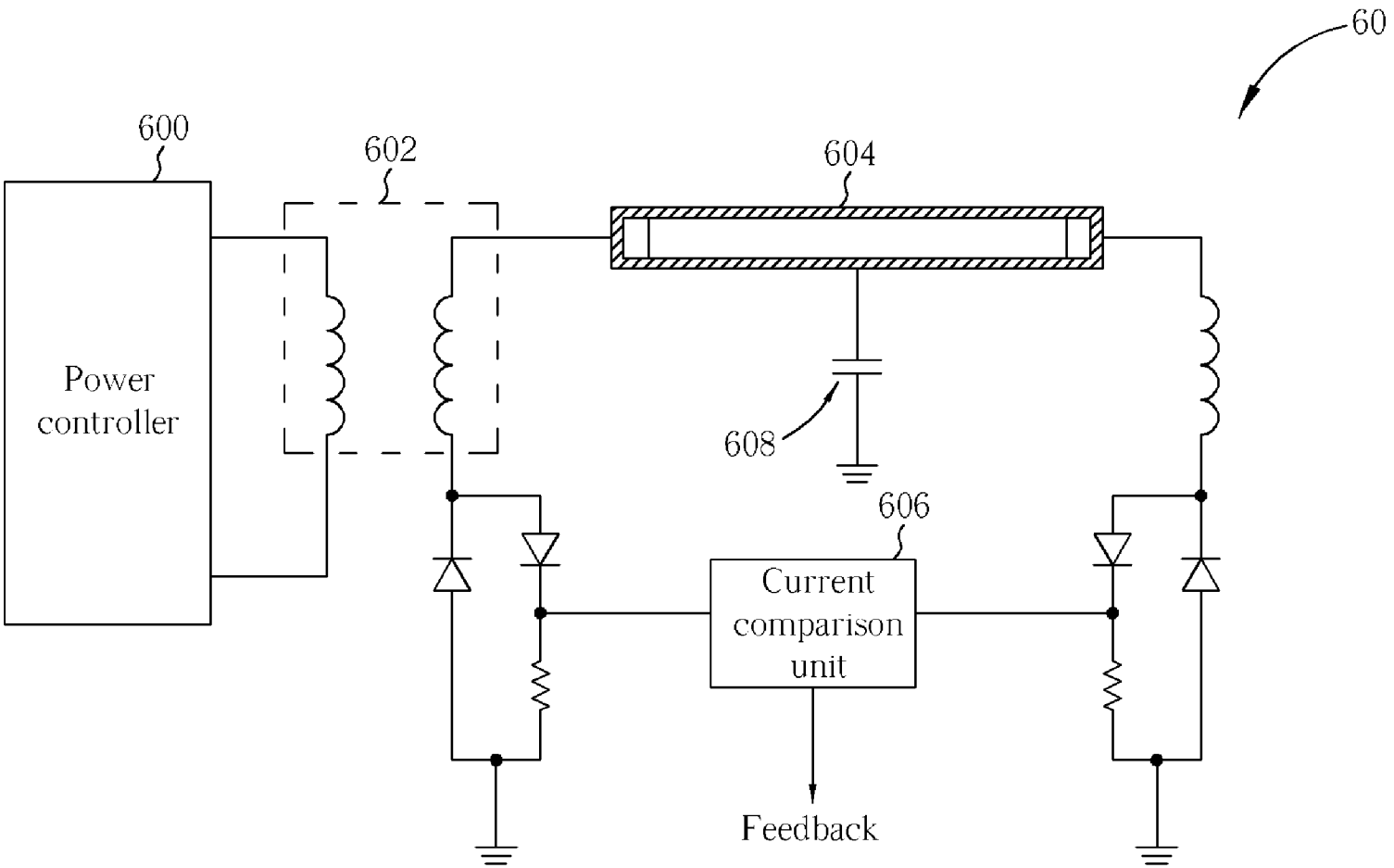
FIG. 6 illustrates a schematic diagram of a light source device of a FPD monitor in accordance with the present invention.

As to an implementation of the process 50, please refer to FIG. 6, which illustrates a schematic diagram of a light source device 60 of a FPD monitor in accordance with the present invention. In FIG. 6, the power controller 600 provides alternating currents for a CCFL 604 through a transformer 602. The CCFL 604 generates light corresponding to different current levels, and feeds a current of one end of the CCFL 604 back to a current comparison unit 606. The current comparison unit 606 takes a lower current of the currents received from two ends of the CCFL 604 as a feedback signal, and outputs the feedback signal (the lower current) to the power controller 600. The CCFL 604 is covered by a conductive layer, so between the CCFL 604 and a system ground is significant parasitic capacitance, which is represented by a capacitor 608 in FIG. 6. The capacitor 608 results in current leakage from the CCFL 604 to the system ground, while the present invention light source device 60 selects the lower current of the currents in the two ends of the CCFL 604 as the feedback signal dynamically. As a result, current leakage caused by parasitic capacitance can be reduced in the light source device 60.

Figure 7:
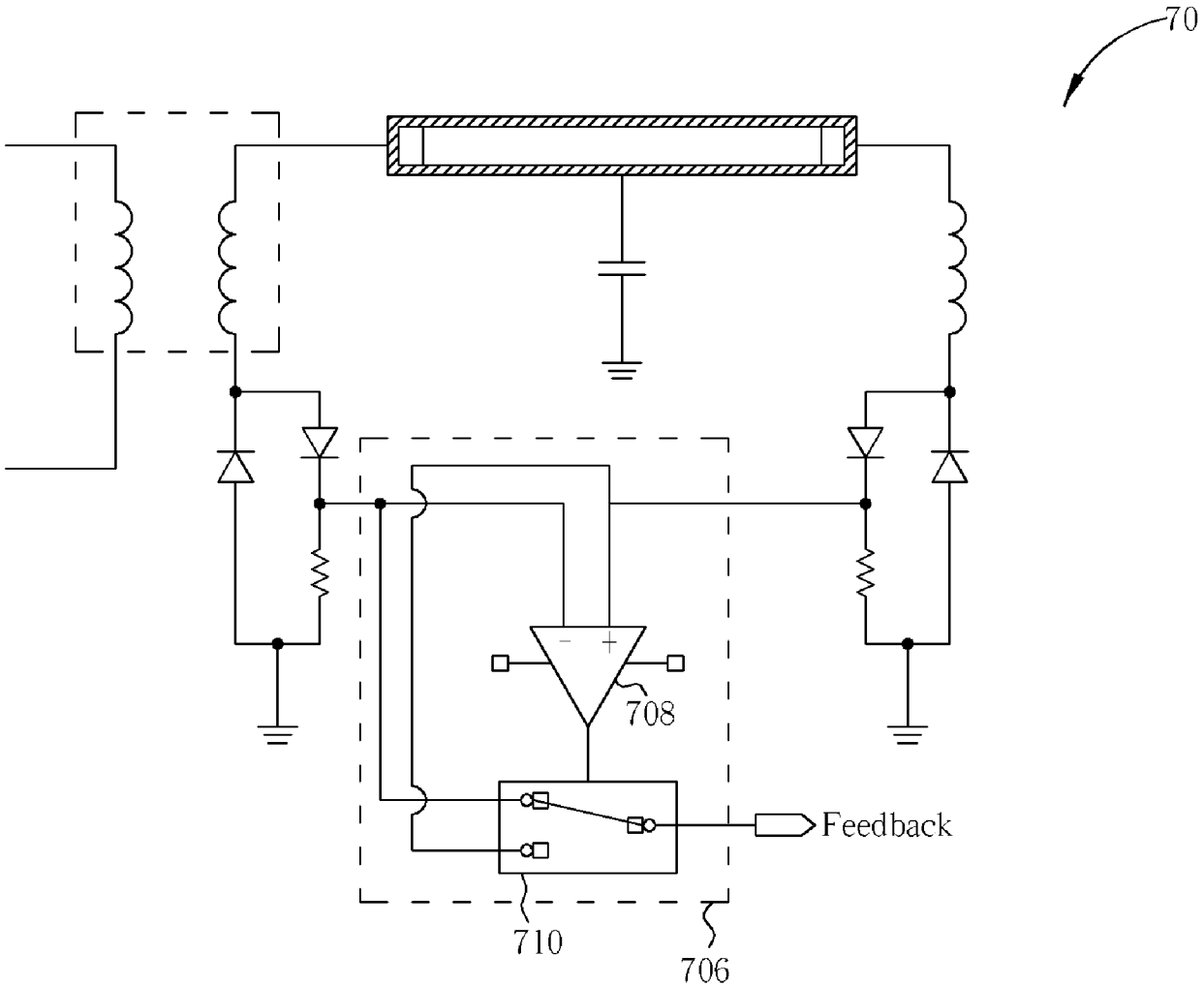
FIG. 7 illustrates a schematic diagram of a light source device of a FPD monitor in accordance with the present invention.

In FIG. 6, the current comparison unit 606 can be one of many structures. Please refer to FIG. 7, which illustrates a schematic diagram of an embodiment of a light source device 70 in accordance with the present invention. The light source device 70 is like the light source device 60, and a current comparison unit 706 in the light source device 70 is an implementation of the current comparison unit 606 in the light source device 60. The current comparison unit 706 includes an operation amplifier 708 and a selection circuit 710. The operation amplifier 708 compares currents of two ends of a CCFL, and the selection circuit 710 selects a lower current of the currents of the two ends as feedback for a power controller according to signals provided by the operation amplifier 708. As a result, currents in the CCFL can be stabilized, so as to prevent the thermometer effect, and decrease current leakage.

Figure 8:
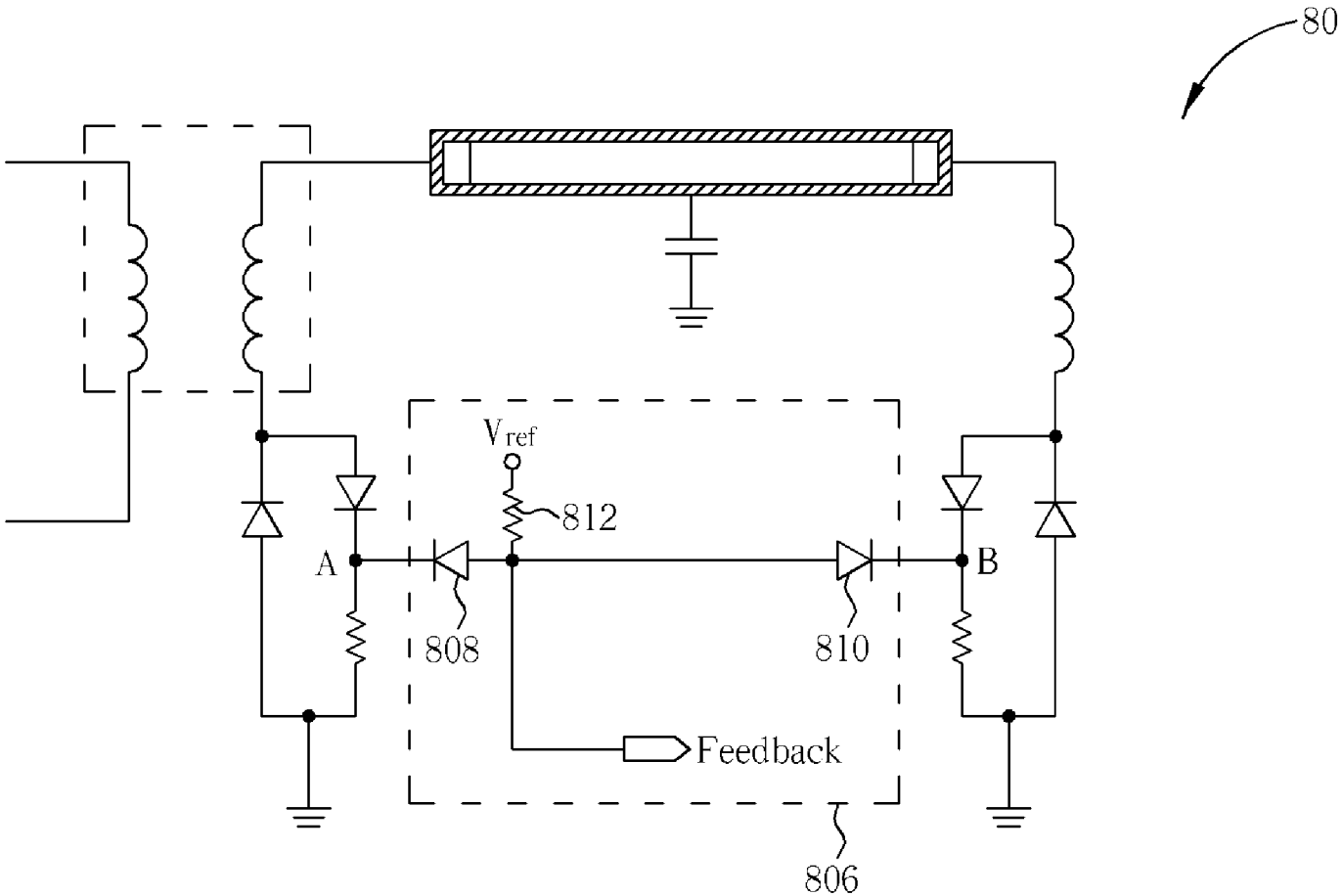
FIG. 8 illustrates a schematic diagram of a light source device of a FPD monitor in accordance with the present invention.

In addition, please refer to FIG. 8 (and FIG. 6), which illustrates a schematic diagram of another embodiment of a light source device 80 in accordance with the present invention. The light source device 80 is like the light source device 60, and a current comparison unit 806 in the light source device 80 is an implementation of the current comparison unit 606 in the light source device 60. The current comparison unit 806 includes a first diode 808, a second diode 810, and a resistor 812. Anode ends of the first diode 808 and the second diode 810 are connected to the resistor 812. Cathode end of the first diode 808 is connected to point A, and cathode end of the second diode 810 is connected to point B. In FIG. 8, a reference voltage Vref is higher than voltages at points A and B. If the voltage at point A is higher than the voltage at point B, the second diode 810 is turned on and the first diode 808 is cut off. Then, the current comparison unit 806 takes the voltage at the point B as a feedback signal. Oppositely, if the voltage at the point B is higher than the voltage at the point A, the first diode 808 is turned on and the second diode 810 is cut off, and the current comparison unit 806 takes the voltage at the point A as the feedback signal. That is, the current comparison unit 806 always takes the lower current of the two ends of the CCFL as the feedback signal.

In summary, the present invention takes the lower current of the two ends of the CCFL as the feedback signal, and provides currents for the CCFL accordingly, so as to increase stability of the CCFL. In comparison, the prior art suffers the thermometer effect, and generates current leakage owing to parasitic capacitance, resulting in low accuracy and efficiency. On the other hand, the present invention selects the feedback signal dynamically, which can prevent the thermometer effect, reduce current leakage caused by parasitic capacitance, and increase accuracy and efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for stabilizing brightness of a cold cathode fluorescent lamp comprising:

receiving currents from two ends of the cold cathode fluorescent lamp;

determining an end having a lower current within the two ends of the cold cathode fluorescent lamp;

selectively outputting only the lower current to a power controller; and providing a signal with the power controller for controlling the cold cathode fluorescent lamp according to the lower current.

2. A light source device capable of stabilizing brightness comprising:

a cold cathode fluorescent lamp;

a current comparison unit, comprising:

an operation amplifier coupled to two ends of the cold cathode fluorescent lamp for comparing currents of the two ends of the cold cathode fluorescent lamp; and a selection circuit coupled to the two ends of the cold cathode fluorescent lamp and the operation amplifier for outputting a lower current of the two ends according to a signal outputted from the operation amplifier; and a power controller coupled to the current comparison unit for controlling the cold cathode fluorescent lamp according to the lower current outputted from the current comparison unit.

3. A light source device capable of stabilizing brightness comprising:

a cold cathode fluorescent lamp;

a current comparison unit, comprising:

a first diode comprising a cathode end coupled to an end of the cold cathode fluorescent lamp, and an anode end coupled to a reference voltage generator;

a second diode comprising a cathode end coupled to another end of the cold cathode fluorescent lamp, and an anode end coupled to the reference voltage generator; and an output end coupled to the anode end of the first diode and the anode end of the second diode for outputting the lower current of the currents of the two ends of the cold cathode fluorescent lamp; and a power controller coupled to the current comparison unit for controlling the cold cathode fluorescent lamp according to lower current outputted from the current comparison unit.

4. The light source device of claim 3, wherein the current comparison unit further comprises a resistor between the reference voltage generator and the output end.

5. The light source device of claim 3, wherein a reference voltage generated by the reference voltage generator is higher than voltages of the two ends of the cold cathode fluorescent lamp.

* * * * *